US010951978B2

(12) United States Patent
Matsuo

(10) Patent No.: US 10,951,978 B2
(45) Date of Patent: Mar. 16, 2021

(54) OUTPUT CONTROL OF SOUNDS FROM SOURCES RESPECTIVELY POSITIONED IN PRIORITY AND NONPRIORITY DIRECTIONS

(71) Applicant: FUJITSU LIMITED, Kawasaki (JP)

(72) Inventor: Naoshi Matsuo, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 211 days.

(21) Appl. No.: 16/358,871

(22) Filed: Mar. 20, 2019

(65) Prior Publication Data

US 2019/0222927 A1 Jul. 18, 2019

Related U.S. Application Data

(63) Continuation of application No. PCT/JP2018/004182, filed on Feb. 7, 2018.

(30) Foreign Application Priority Data

Mar. 21, 2017 (JP) ..... JP2017-054257

(51) Int. Cl.
*H04R 1/40* (2006.01)
*H04R 1/34* (2006.01)
(Continued)

(52) U.S. Cl.
CPC ..... *H04R 1/345* (2013.01); *H04R 3/005* (2013.01); *H04R 1/406* (2013.01); *H04R 3/04* (2013.01);
(Continued)

(58) Field of Classification Search
CPC ..... G10L 2021/02166; G10L 15/00; G10L 15/20; G10L 21/02; G10L 21/028;
(Continued)

(56) References Cited

U.S. PATENT DOCUMENTS 6,339,758 B1 1/2002 Kanazawa et al.
2005/0278083 A1 12/2005 Shikano et al.
(Continued)

FOREIGN PATENT DOCUMENTS

JP 2000-047699 A 2/2000
JP 2000-194394 A 7/2000
(Continued)

OTHER PUBLICATIONS

International Search Report and its English Translation, and Written Opinion of the International Searching Authority (Form PCT/ISA/210, 220, and 237), mailed in connection with PCT/JP2018/004182 and dated Apr. 24, 2018 (10 pages).

*Primary Examiner* — Kile O Blair
(74) *Attorney, Agent, or Firm* — Fujitsu Patent Center

(57) ABSTRACT

An apparatus divides each of first and second sound-signals generated respectively by first and second sound-input devices, into frames having a predetermined time length, and converts each frame of the first and second sound-signals into first and second frequency-spectra, respectively, in a frequency domain. For each frame, the apparatus calculates, based on the first and second frequency-spectra, a probability that a sound of the frame is emitted only from a sound-source positioned in a second direction among a first direction prioritized with respect to sound reception and the second direction, and outputs a first directivity sound-signal including a sound coming from the first direction, while controlling, depending on the probability, output of the first directivity sound-signal and a second directivity sound-signal including a sound coming from the second direction, where each of the first and second directivity sound-signals is calculated based on the first and second frequency-spectra.

9 Claims, 9 Drawing Sheets

(51) Int. Cl.
*H04R 3/00* (2006.01)
*H04R 3/04* (2006.01)

(52) U.S. Cl.
CPC ..... *H04R 2430/20* (2013.01); *H04R 2499/13* (2013.01)

(58) Field of Classification Search
CPC ..... G10L 25/84; H04R 1/406; H04R 2430/20; H04R 3/005; H04R 3/04
See application file for complete search history.

(56) References Cited

U.S. PATENT DOCUMENTS

| | | | |
|---|---|---|---|
| 2007/0274536 | A1 | 11/2007 | Matsuo |
| 2011/0158426 | A1 | 6/2011 | Matsuo |
| 2016/0372129 | A1 | 12/2016 | Nakadai et al. |

FOREIGN PATENT DOCUMENTS

| | | | |
|---|---|---|---|
| JP | 2005-350018 | A | 12/2005 |
| JP | 2006-58395 | A | 3/2006 |
| JP | 2006-126424 | A | 5/2006 |
| JP | 2007-219207 | A | 8/2007 |
| JP | 2007-318528 | A | 12/2007 |
| JP | 2011-139378 | A | 7/2011 |
| JP | 2017-9700 | A | 1/2017 |
| WO | 2015/086895 | A1 | 6/2015 |

OUTPUT CONTROL OF SOUNDS FROM SOURCES RESPECTIVELY POSITIONED IN PRIORITY AND NONPRIORITY DIRECTIONS

CROSS-REFERENCE TO RELATED APPLICATION

This application is a continuation application of International Application PCT/JP2018/004182 filed on Feb. 7, 2018 and designated the U.S., the entire contents of which are incorporated herein by reference. The International Application PCT/JP2018/004182 is based upon and claims the benefit of priority of the prior Japanese Patent Application No. 2017-054257, filed on Mar. 21 2017, the entire contents of which are incorporated herein by reference.

FIELD

The embodiments discussed herein are related to output control of sounds from sources respectively positioned in priority and nonpriority directions.

BACKGROUND

In recent years, sound processing devices for processing a sound signal obtained by collecting a sound by a plurality of microphones have been developed. In the sound processing devices, techniques for suppressing a sound from a direction other than a specific direction in the sound signal have been studied in order to facilitate listening to a sound from the specific direction included in the sound signal (see, for example, Japanese Laid-open Patent Publication No. 2007-318528 and Japanese Laid-open Patent Publication No. 2011-139378).

SUMMARY

According to an aspect of the embodiments, an apparatus divides each of a first sound signal generated by a first sound input device and a second sound signal generated by a second sound input device disposed at a position different from the first sound input device, into frames having a predetermined time length, and converts each frame of the first sound signal and each frame of the second sound signal into a first frequency spectrum and a second frequency spectrum, respectively, in a frequency domain. The apparatus calculates, for each frame, based on the first frequency spectrum and the second frequency spectrum, a probability that a sound of the frame is emitted only from a sound source positioned in a second direction among sound sources positioned in a first direction which is prioritized with respect to sound reception and the second direction different from the first direction, and outputs, for each frame, a first directivity sound signal including a sound coming from the first direction, while controlling, depending on the probability, output of the first directivity sound signal and a second directivity sound signal including a sound coming from the second direction, where each of the first directivity sound signal and the second directivity sound signal is calculated based on the first frequency spectrum and the second frequency spectrum.

The object and advantages of the invention will be realized and attained by means of the elements and combinations particularly pointed out in the claims.

It s to be understood that both the foregoing general description and the following detailed description are exemplary and explanatory and are not restrictive of the invention.

DESCRIPTION OF EMBODIMENTS

In some cases, it is preferable not to suppress not only a sound from a sound source positioned in a specific direction, but also a sound from another sound source positioned in another direction. However, for example, in the technique described in Japanese Laid-open Patent Publication No. 2007-318528, a sound coming from a direction other than the specific direction is suppressed. On the other hand, for example, in the technique described in Japanese Laid-open Patent Publication No. 2011-139378, when a sound from another sound source positioned in another assumed direction in addition to sound from a sound source positioned in a specific direction is intended to be not suppressed, the noise suppression is insufficient because the range in the direction where the sound is not to be suppressed is too wide. As a result, there is a possibility that audibility of a sound from a sound source positioned in a specific direction may not be sufficiently improved.

It is preferable to output not only a sound from a sound source positioned in a direction having a priority, but also a sound from another sound source positioned in another direction without suppressing them.

Hereinafter, a sound processing device will be described with reference to the drawings. The sound processing device, in a sound signal obtained by a plurality of sound input units calculates, for each frame, the probability that the sound is generated only by the sound source positioned in the second direction among a first direction in which a sound source having priority is positioned, and a second direction in which another sound source is assumed to be positioned. With respect to the frame where the probability is high, the sound processing device outputs not only the first directivity sound signal including the sound coming from the first direction, but also the second directivity sound signal including sound coming from the second direction. For example, when the probability is high, this sound processing device extends the sound receiving direction temporarily to include the second direction.

Figure 1:
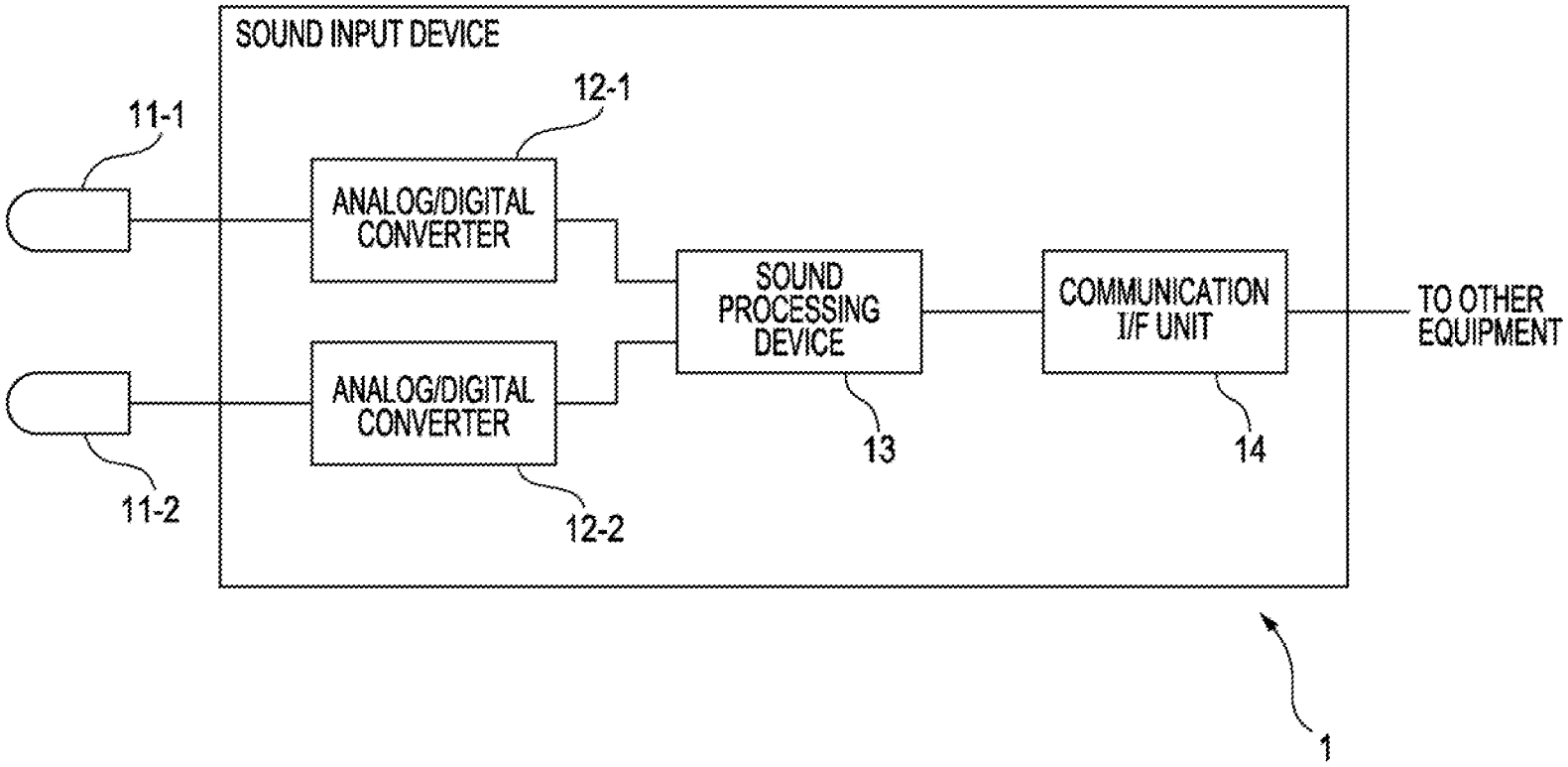
FIG. 1 is a schematic configuration diagram of a sound input device on which a sound processing device according to an embodiment is mounted.

FIG. 1 is a schematic configuration diagram of a sound input device on which the sound processing device according to an embodiment is mounted. A sound input device 1 includes two microphones 11-1 and 11-2, two analog/digital converters 12-1 and 12-2, a sound processing device 13, and a communication interface unit 14. The sound input device 1, which is mounted on, for example, a vehicle (not illustrated), collects a sound emitted from the driver or a passenger, and outputs a sound signal including the sound to a navigation system (not illustrated) or a hands-free phone (not illustrated) or the like. The sound processing device 13 sets directivities of sound reception in which a sound from a direction other than the direction in which the driver is positioned is suppressed. In a case where the probability that a sound is emitted only from the passenger is high among the direction in which the driver is positioned (first direction) and the direction in which the passenger is positioned (second direction), the sound processing device 13 changes directivities so as not to suppress the sound coming from the second direction.

The microphones 11-1 and 11-2 are an example of the sound input unit. The microphone 11-1 and the microphone 11-2 are, for example, disposed in the instrument panel or in the vicinity of the ceiling in the vehicle compartment between, for example, the driver as a sound source whose sound is to be collected, and the passenger in a passenger seat (hereinafter simply referred to as the passenger), which is another sound source. In the embodiment, the microphone 11-1 and the microphone 11-2 are disposed such that the microphone 11-1 is positioned closer to the passenger than the microphone 11-2 and the microphone 11-2 is positioned closer to the driver than the microphone 11-1. The analog input sound signal generated by the microphone 11-1 collecting surrounding sounds is input to the analog/digital converter 12-1. Similarly, the analog input sound signal generated by the microphone 11-2 collecting surrounding sounds is input to the analog/digital converter 12-2.

The analog/digital converter 12-1 samples the analog input sound signal received from the microphone 11-1 at a predetermined sampling frequency to generate a digitized input sound signal. Similarly, the analog/digital converter 12-2 samples the analog input sound signal received from the microphone 11-2 at a predetermined sampling frequency to generate a digitized input sound signal.

Hereinafter, for convenience of explanation, the input sound signal generated by the microphone 11-1 collecting sound, and digitized by the analog/digital converter 12-1 is referred to as a first input sound signal. The input sound signal generated by the microphone 11-2 collecting a sound, and digitized by the analog/digital converter 12-2 is referred to as a second input sound signal. The analog/digital converter 12-1 outputs the first input sound signal to a sound processing device 13. Similarly, the analog/digital converter 12-2 outputs the second input sound signal to the sound processing device 13.

The sound processing device 13 includes, for example, one or more processors, and a memory. The sound processing device 13 generates, from the received first input sound signal and the received second input sound signal, a directivity sound signal in which noise coming from a direction other than the direction in which a sound is received in accordance with the directivities to be controlled has been suppressed. The sound processing device 13, via the communication interface unit 14, outputs the directivity sound signal to other equipment such as a navigation system (not illustrated) or a hands-free phone (not illustrated).

The communication interface unit 14 includes a communication interface circuit and the like for coupling the sound input device 1 to other equipment in accordance with a predetermined communication standard. For example, the communication interface circuit may be a circuit that operates in accordance with a short-distance wireless communication standard usable for sound signal communication, such as Bluetooth (registered trademark), or a circuit operating in accordance with a serial bus standard such as universal serial bus (USB). The communication interface unit 14 outputs the output sound signal received from the sound processing device 13 to other equipment.

Figure 2:
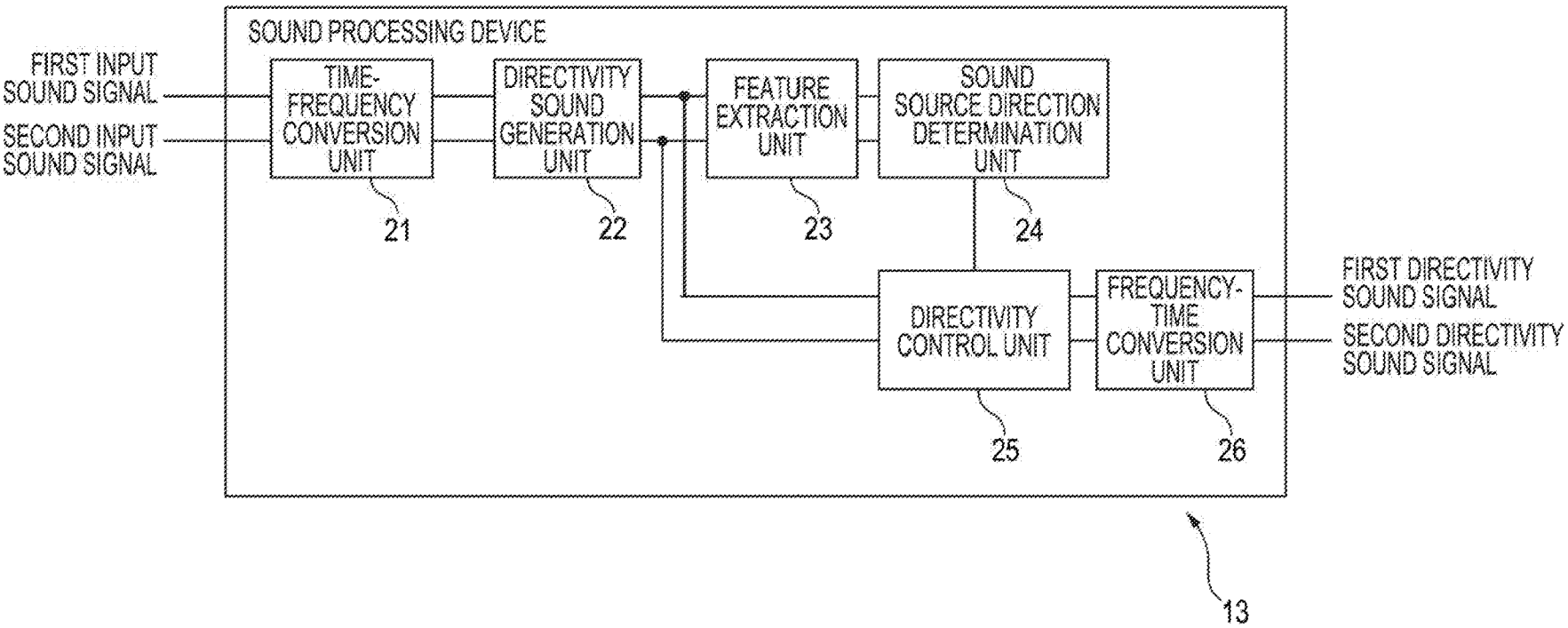
FIG. 2 is a schematic configuration diagram of a sound processing device.

FIG. 2 is a schematic configuration diagram of the sound processing device 13 according to an embodiment. The sound processing device 13 includes a time-frequency conversion unit 21, a directivity sound generation unit 22, a feature extraction unit 23, a sound source direction determination unit 24, a directivity control unit 25, and a frequency-time conversion unit 26. These units included in the sound processing device 13 are constructed, for example, as functional modules implemented by a computer program executed on a processor included in the sound processing device 13. Alternatively, separated from the processor of the sound processing device 13, these units included in the sound processing device 13 may be mounted on the sound processing device 13 as one or more integrated circuits that implement the functions of the respective units.

For each of the first input sound signal and the second input sound signal, the time-frequency conversion unit 21 calculates a frequency spectrum including an amplitude component and a phase component for each of the plurality of frequencies by converting from time domain to frequency domain on a frame-by-frame basis. Since the time-frequency conversion unit 21 may perform the same processing for each of the first input sound signal and the second input sound signal processing on the first input sound signal will be described below.

In the embodiment, the time-frequency conversion unit 21 divides the first input sound signal for each frame having a predetermined frame length (for example, several tens of milliseconds). At this time, the time-frequency conversion unit 21 sets each frame so that, for example, two consecutive frames are shifted by ½ of the frame length.

The time-frequency conversion unit 21 performs window processing for each frame. For example, the time-frequency conversion unit 21 multiplies each frame by a predetermined window function. For example, the time-frequency conversion unit 21 may use a Hanning window as a window function.

The time-frequency conversion unit 21 calculates a frequency spectrum including an amplitude component and a phase component for each of the plurality of frequencies by converting the frame from the time domain to the frequency domain each time it receives the frame for which window processing has been performed. The time-frequency conversion unit 21, for example, may calculates a frequency spectrum by performing the time-to-frequency conversion such as a Fast Fourier Transform (FFT) for a frame. Hereinafter, for convenience, the frequency spectrum obtained for the first input sound signal is referred to as a first frequency spectrum, and the frequency spectrum obtained for the second input sound signal is referred to as a second frequency spectrum.

The time-frequency conversion unit 21 outputs, for each frame, the first frequency spectrum and the second frequency spectrum to the directivity sound generation unit 22.

The directivity sound generation unit 22 generates, for each frame, a first directivity sound spectrum representing the frequency spectrum of the sound coming from the first direction which is prioritized with respect to sound reception (in the embodiment, the direction in which the driver is positioned) as viewed from the microphones 11-1 and 11-2. The directivity sound generation unit 22 generates, for each frame, a second directivity sound spectrum representing the frequency spectrum of the sound coming from the second direction in which another sound source is assumed to be positioned (in the embodiment, the direction in which the passenger is positioned) as viewed from the microphones 11-1 and 11-2.

First, the directivity sound generation unit 22 determines, for each frame, the phase difference between the first frequency spectrum and the second frequency spectrum for each frequency. Since this phase difference varies in accordance with the direction from which the sound comes in the frame, this phase difference may be used to specify the direction from which the sound comes. For example, a phase difference calculation unit 12 calculates a phase difference spectrum $\Delta\theta(f)$ representing a phase difference for each frequency in accordance with the following Expression.

$$\Delta\theta(f) = \tan^{-1}\left(\frac{IN1(f)}{IN2(f)}\right) 0 < f < Fs/2 \quad (1)$$

where IN1(f) represents the first frequency spectrum, and IN2(f) represents the second frequency spectrum.

f represents a frequency. Fs represents a sampling frequency in the analog/digital converters 12-1 and 12-2.

Figure 3:
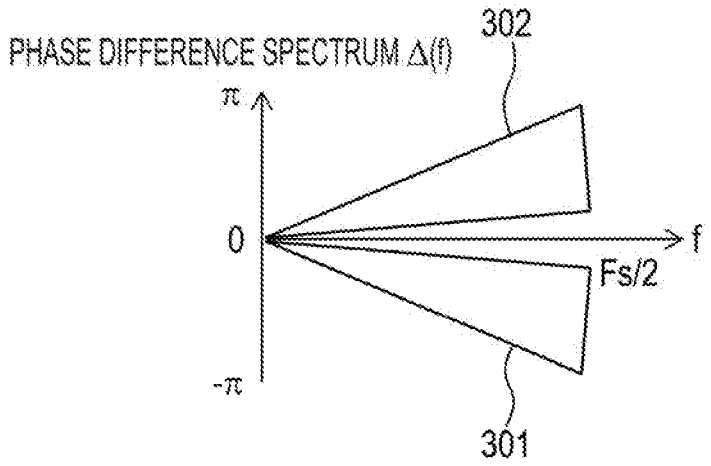
FIG. 3 is a diagram illustrating an example of the relationship between an incoming direction of a sound and a phase difference spectrum.

FIG. 3 is a diagram illustrating an example of the relationship between the incoming direction of a sound and the phase difference spectrum $\Delta\theta(f)$. In FIG. 3, the horizontal axis represents a frequency, the vertical axis represents a phase difference spectrum. A phase difference spectrum range 301 represents a range in which the phase difference for each frequency when the sound coming from the first direction (in the embodiment, the direction in which the driver is positioned) is included in the first input sound signal and the second input, sound signal may exist. On the other hand, a phase difference spectrum range 302 represents a range in which the phase difference for each frequency when the sound coming from the second direction (in the embodiment, the direction in which the passenger is positioned) is included in the first input sound signal and the second input sound signal may exist.

The microphone 11-2 is closer to the driver than the microphone 11-1. For this reason, the timing at which the sound generated by the driver reaches the microphone 11-1 is later than the timing at which the sound generated by the driver reaches the microphone 11-2. As a result, the phase of the sound generated by the driver represented by a first frequency spectrum is later than the phase of the sound generated by the driver represented by a second frequency spectrum. For this reason, the phase difference spectrum range 301 is positioned on the negative side. The range of the phase difference due to the delay is widened as the frequency increases. Conversely, the microphone 11-1 is closer to the passenger than the microphone 11-2. For this reason, the timing at which the sound generated by the passenger reaches the microphone 11-2 is later than the timing at which the sound generated by the passenger reaches the microphone 11-1. As a result, the phase of the sound generated by the fellow passenger represented in the first frequency spectrum is advanced beyond the phase of the sound generated by the passenger represented in the second frequency spectrum. For this reason, the phase difference spectrum range 302 is positioned on the positive side. The range of the phase difference is widened as the frequency increases.

The directivity sound generation unit 22 determines, for each frame, with reference to the phase difference spectrum $\Delta\theta(f)$, whether the phase difference is included in the phase difference spectrum range 301 or included in the phase difference spectrum range 302 for each frequency. The directivity sound generation unit 22 determines, for each frame, that the component of the frequency at which the phase difference is included in the phase difference spectrum range 301 among the first and second frequency spectra is a component which is included in the sound coming from the first direction. The directivity sound generation unit 22 extracts, for each frame, from the first frequency spectrum, the component of the frequency at which the phase difference is included in the phase difference spectrum range 301 to obtain the first directivity sound spectrum. For example, the directivity sound generation unit 22 multiplies the gain which is 1 by the component of the frequency at which the phase difference is included in the phase difference spectrum range 301. On the other hand, the directivity sound generation unit 22 multiplies the gain which is 0 by the component of the frequency at which the phase difference is not included in the phase difference spectrum range 301. In this way, the directivity sound generation unit 22 generates the first directivity sound spectrum. The directivity sound generation unit 22 may multiply the gain which decreases as the distance from the phase difference spectrum range 301 increases by the component of the frequency at which the phase difference is not the phase difference spectrum range 301, and the obtained component of the frequency may be included in the first directivity sound spectrum. The directivity sound generation unit 22 may extract, for each frame, from the second frequency spectrum, the component of the frequency at which the phase difference is included in the phase difference spectrum range 301 to obtain the first directivity sound spectrum.

Similarly, the directivity sound generation unit 22 determines, for each frame, that the component of the frequency at which the phase difference is included in the phase difference spectrum range 302 among the first and second frequency spectra is a component which is included in the sound coming from the second direction. The directivity sound generation unit 22 extracts, for each frame, from the first frequency spectrum, the component of the frequency at which the phase difference is included in the phase difference spectrum range 302 to obtain the second directivity sound spectrum. The directivity sound generation unit 22 may multiply the gain which decreases as the distance from the phase difference spectrum range 302 increases by the component of the frequency at which the phase difference is not the phase difference spectrum range 302, and the obtained component of the frequency may be included in the second directivity sound spectrum. The directivity sound generation unit 22 may extract, for each frame, from the second frequency spectrum, the component of the frequency at which the phase difference is included in the phase difference spectrum range 302 to obtain the second directivity sound spectrum.

The directivity sound generation unit 22 outputs, for each frame, each of the first directivity sound spectrum and the second directivity sound spectrum to the feature extraction unit 23 and the directivity control unit 25.

The feature extraction unit 23 calculates, for each frame, a feature amount representing the likelihood of the sound from the sound source with respect to the frame, based on the first directivity sound spectrum and the second directivity sound spectrum.

Since the sound from the first direction increases with respect to the frame including the sound generated by the sound source (driver in this example) located in the first direction, it is assumed that the power of the first directivity sound spectrum increases to some extent. Similarly, since the sound from the second direction increases with respect to the frame including the sound generated by the sound source (passenger in this example) located in the second direction, it is assumed that the power of the second directivity sound spectrum increases to some extent. It is assumed that the power of the sound of the driver and the power of the sound of the passenger change over time. Therefore, in the embodiment, the feature extraction unit 23 calculates, for each frame, the power and a non-stationarity degree with respect to power (hereinafter simply referred to as non-stationarity degree) as a feature amount with respect to each of the first directivity sound spectrum and the second directivity sound spectrum.

For example, the feature extraction unit 23 calculates, for each frame, the power PX of the first directivity sound spectrum and the power PY of the second directivity sound spectrum in accordance with the following Expression.

$$PX = \sum_f X(f)^2 \tag{2}$$

$$PY = \sum_f Y(f)^2$$

where X(f) is the first directivity sound spectrum for the frame of interest, and Y(f) is the second directivity sound spectrum for the frame of interest.

The feature extraction unit 23 calculates, for each frame, the non-stationarity degree RX of the first directivity sound spectrum and the non-stationarity degree RY of the second directivity sound spectrum in accordance with the following Expression.

$$RX=|10\times\log_{10}(PX/PX')|$$

$$RY=|10\times\log_{10}(PY/PY')| \tag{3}$$

where PX' represents the power of the first directivity sound spectrum for the frame immediately preceding the frame of interest, and PY' represents the power of the second directivity sound spectrum for the frame immediately preceding the frame of interest. The feature extraction unit 23 transfers, for each frame, the calculated feature an amount to the sound source direction determination unit 24.

The sound source direction determination unit 24 determines, for each frame, based on the feature amount of the first directivity sound spectrum and the feature amount of the second directivity sound spectrum, determines the probability that the sound is generated only by the sound source positioned in the second direction among the first direction and the second direction in the frame. Hereinafter, the probability that the sound is generated only by the sound source positioned in the second direction among the first direction and the second direction is simply referred to as the probability that the sound is generated only by the sound source positioned in the second direction.

As described above, for the frame including a sound generated by a sound source positioned in the first direction, it is assumed that the power and the non-stationarity degree of the first directivity sound spectrum are increased to some extent. On the other hand, for the frame including the sound generated by the sound source positioned in the second direction, it is assumed that the power and the non-stationarity degree of the second directivity sound spectrum are increased to some extent. Therefore, the sound source direction determination unit 24 calculates, for each frame, the probability P that the sound is generated only by the sound source positioned in the second direction in accordance with the following Expression.

$$P = \frac{PY}{PX} + \frac{RY}{RX} \tag{4}$$

Therefore, the larger the value of probability P is, the higher the possibility that only the sound source positioned in the second direction among the first direction and the second direction is generating a sound. The sound source direction determination unit 24 notifies, for each frame, the directivity control unit 25 of the probability P that the sound is generated only by the sound source positioned in the second direction.

The directivity control unit 25, together with the frequency-time conversion unit 26, constitutes an example of the directivity sound output unit. The directivity control unit 25 control, for each frame, directivities of a received sound in accordance with the probability that the sound is generated only by the sound source positioned in the second direction. In the embodiment, the directivity control unit 25 constantly outputs the first directivity sound spectrum, and outputs the second directivity sound spectrum by which the gain representing the degree of suppression is multiplied. The directivity control unit 25 controls the gain in accordance with the probability P.

In the embodiment, the directivity control unit 25 compares, for each frame, the calculated probability p with at least one likelihood determination threshold value. For example, in a case where the probability P is greater than a first likelihood determination threshold value Th1 with respect to the frame of interest, the directivity control unit 25 determines that the probability that the sound is generated only by the sound source positioned in the second direction in that frame is high. On the other hand, in a case where the probability P is less than a second likelihood determination threshold value Th2 (where Th2<Th1) with respect to the frame of interest, the directivity control unit 25 determines that the probability that the sound is generated only by the sound source positioned in the second direction in that frame is low. When the probability P is equal to or greater than the second likelihood determination threshold value Th2 and is equal to or less than the first likelihood determination threshold value Th1 with respect to the frame of interest, the sound source direction determination unit 24 determines that the probability that the sound is generated only by the sound source positioned in the second direction in the frame is moderate.

In a case where the probability that the sound is generated only by the sound source positioned in the second direction is low with respect to the frame of interest, the directivity control unit 25 outputs only the first directivity sound spectrum among the first directivity sound spectrum and the second directivity sound spectrum. For example, the directivity control unit 25 sets the gain by which the second directivity sound spectrum is multiplied at 0 to restrict the directivities of a received sound to the first direction. On the other hand, in a case where the probability that the sound is generated only by the sound source positioned in the second direction is high with respect to the frame of interest, the directivity control unit 25 outputs both the first directivity sound spectrum and the second directivity sound spectrum. For example, the directivity control unit 25 sets the gain by which the second directivity sound spectrum is multiplied at 1 to extend the directivities of a received sound not only to the first direction, but also to the second direction.

In a case where the degree of the probability that the sound is generated only by the sound source positioned in the second direction is moderate with respect to the frame of interest, the directivity control unit 25 determines the gain by which the second directivity sound spectrum is multiplied so that the gain is close to 1 as the value of the probability P increases.

Figure 4:
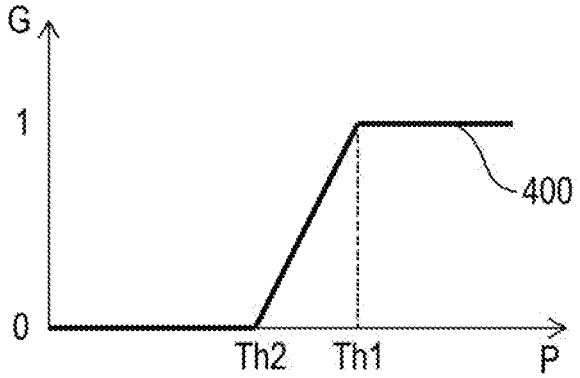
FIG. 4 is a diagram illustrating an example of the relationship between the probability that a sound is generated only by a sound source positioned in a second direction and a gain by which a second directivity sound spectrum is multiplied.

FIG. 4 is a diagram illustrating an example of the relationship between the probability P that the sound is generated only by the sound source positioned in the second direction and the gain G by which the second directivity sound spectrum is multiplied. In FIG. 4, the horizontal axis represents the probability P, and the vertical axis represents the gain G. The graph 400 represents the relationship between the probability P and the gain.

As illustrated in the graph 400, in a case where the probability P is equal to or less than the second likelihood determination threshold value Th2, the gain G is set at 0. In a case where the probability P is equal to or greater than the first likelihood determination threshold value Th1, the gain G is set at 1. In a case where the probability P is greater than the second likelihood determination threshold value Th2 and less than the first likelihood determination threshold value Th1, the gain G monotonically and linearly increases as the probability P increases.

According to the modification, one likelihood determination threshold value Th may be used. In this case, when the probability P is greater than the likelihood determination threshold value Th with respect to the frame of interest, the directivity control unit 25 determines that the probability that the sound is generated only by the sound source positioned in the second direction in the frame is high. On the other hand, in a case where the probability P is equal to or less than the likelihood determination threshold value Th, the directivity control unit 25 determines that the probability that the sound is generated only by the sound source positioned in the second direction in that frame is low.

The likelihood determination threshold values Th1, Th2, and Th are preset, for example, through experiments or the like, and may be stored in the memory of the sound processing device 13 in advance.

Figure 5:
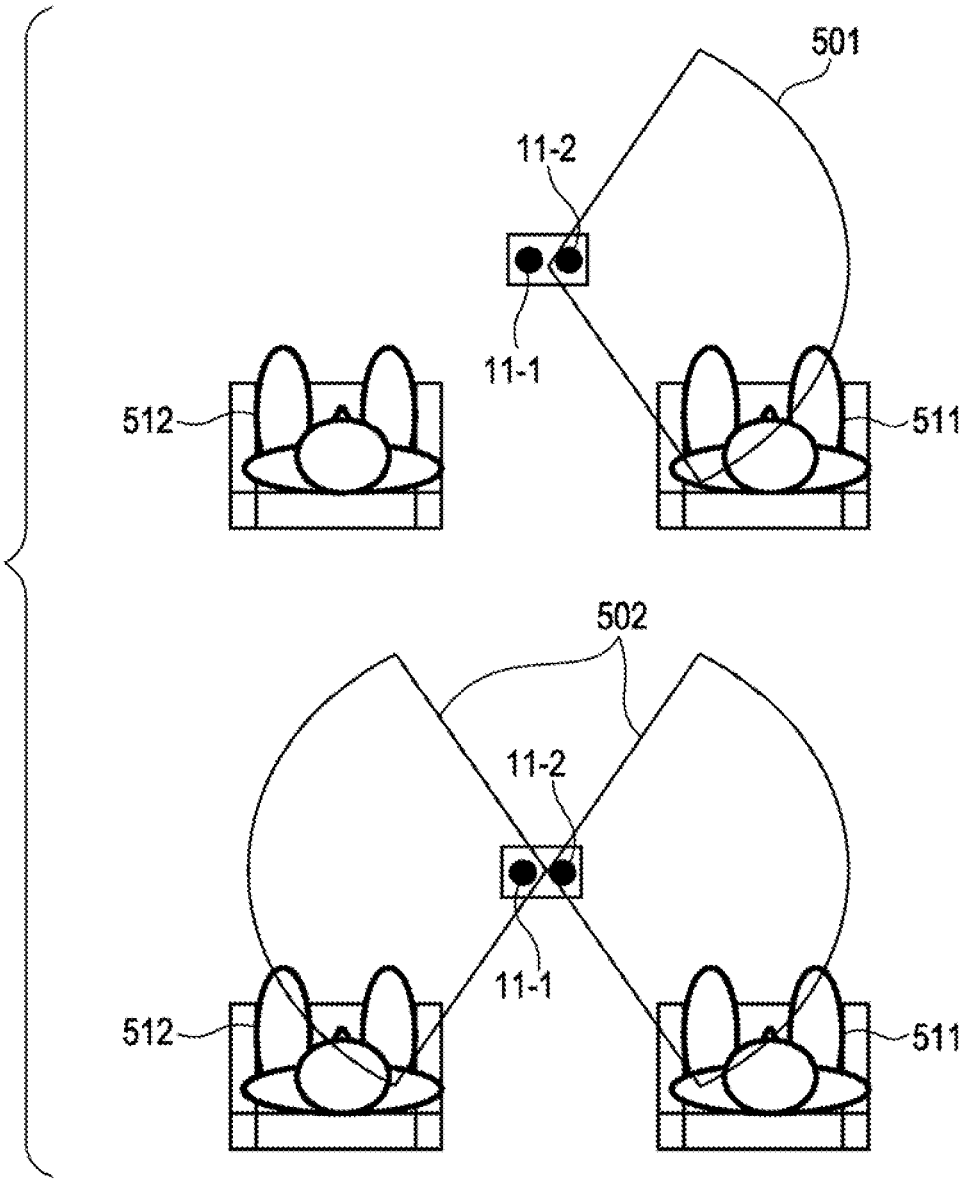
FIG. 5 is a schematic diagram illustrating directivities of a received sound.

FIG. 5 is a schematic diagram illustrating directivities of a received sound. In a case where the degree of the probability that the sound is generated only by the sound source positioned in the second direction is low, a range 501 where the sensitivity with which the sound is received is high, with respect to the arrangement direction of the microphone 11-1 and the microphone 11-2, is set toward the microphone 11-2 where a driver 511 is positioned. On the other hand, in a case where the degree of the probability that the sound is generated only by the sound source positioned in the second direction is high, a range 502 where the sensitivity with which the sound is received is high, with respect to the arrangement direction of the microphone 11-1 and the microphone 11-2, is set toward the microphone 11-2 and the microphone 11-1. In this way, in addition to the direction in which the driver 511 is positioned, the direction in which the fellow passenger 512 is positioned is also included in the range where the sensitivity with which the sound is received is high.

The frequency-time conversion unit 26 acquires, for each frame, the first directivity, sound signal for each frame, by frequency-to-time converting the first directivity sound spectrum output from the directivity control unit 25 into a signal in the time domain. The frequency-time conversion unit 26 acquires the second directivity sound signal for each frame, by frequency-to-time converting, for each frame, the second directivity sound spectrum output from the directivity control unit 25 into a signal in the time domain. This frequency-to-time conversion is an inverse conversion of the time-to-frequency conversion performed by the time-frequency conversion unit 21.

The frequency-time conversion unit 26 calculates the first directivity sound signal by adding the first directivity sound signal for each frame which is continuous in order of time (for example, reproduction order) by shifting the signal by ½ of the frame length. Similarly, the frequency-time conversion unit 26 calculates the second directivity sound signal by adding the second directivity sound signal for each frame which is continuous in order of time (for example, reproduction order) by shifting the signal by ½ of the frame length. The frequency-time conversion unit 26 outputs the first directivity sound signal and the second directivity sound signal to other equipment via the communication interface unit 14.

Figure 6:
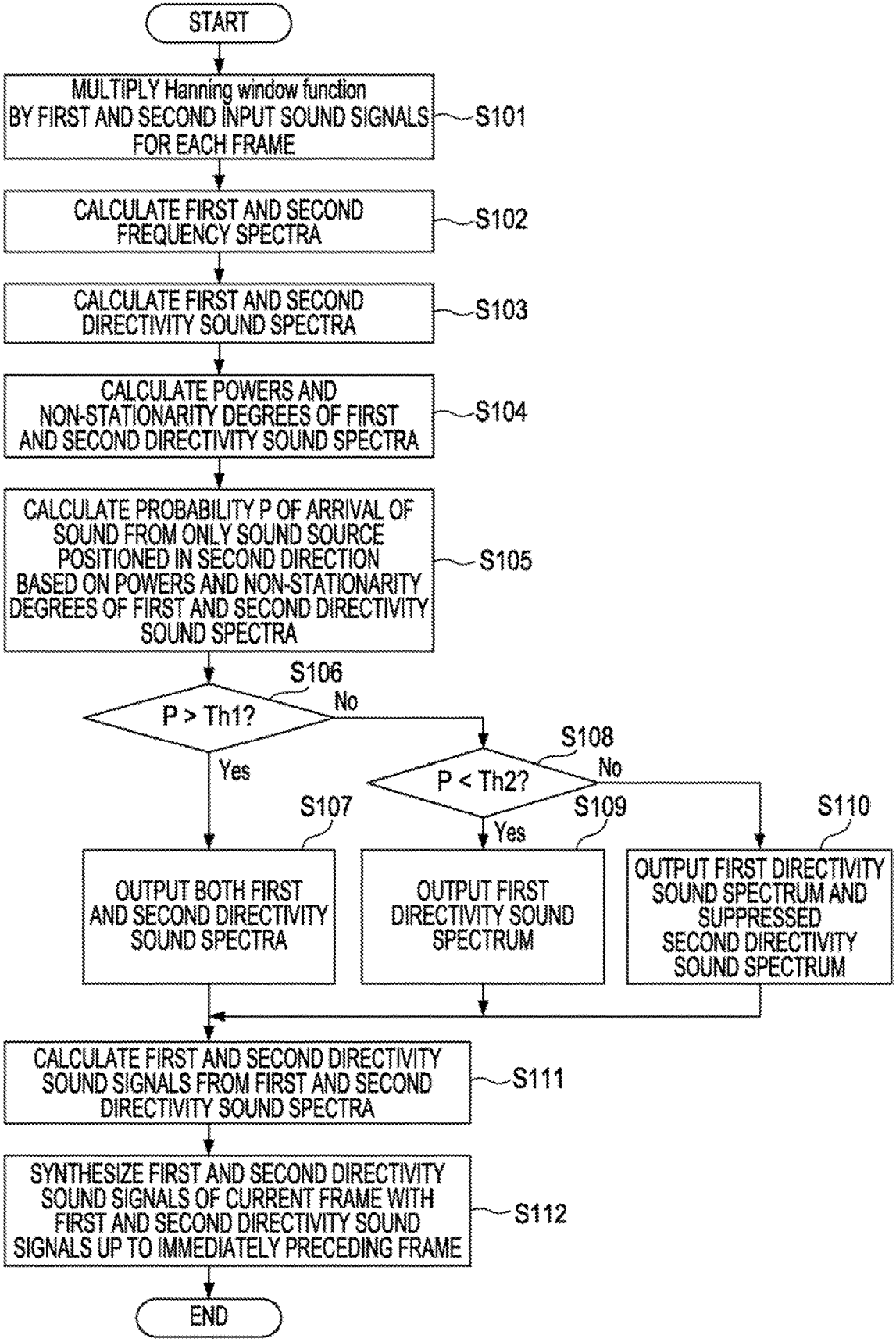
FIG. 6 is an operation flowchart of sound processing.

FIG. 6 is an operation flowchart of the sound processing performed by the sound processing device 13. The sound processing device 13 performs, for each frame, the sound processing in accordance with the following flowchart.

The time-frequency conversion unit 21 multiplies the Hanning window function by the first input sound signal and the second input sound signal divided into frame units (step S101). The time-frequency conversion unit 21 time-to-frequency converts the first input sound signal and the second input sound signal to calculate the first frequency spectrum and the second frequency spectrum (step S102).

The directivity sound generation unit 22 generates the first directivity sound spectrum and the second directivity sound spectrum, based on the first and second frequency spectra (step S103). The feature extraction nit 23 extracts, as a feature amount representing likelihood of the sound from the sound source, calculates the power and the non-stationarity degree of the first directivity sound spectrum, and the power and the non-stationarity degree of the second directivity sound spectrum (step S104).

Based on the power and the non-stationarity degree of each of the first directivity sound spectrum and the second directivity sound spectrum, the sound source direction determination unit 24 calculates the probability P of the sound coming only from the sound source positioned in the second direction among the first and second directions (step S105).

The directivity control unit 25 determines whether the probability P is greater than the first likelihood determination threshold value Th1 (step S106). In a case where the probability P is greater than the first likelihood determination threshold value Th1 ("Yes" in step S106), the directivity control unit 25 outputs both the first directivity sound spectrum and the second directivity sound spectrum (step S107). On the other hand, in a case where the probability P is equal to or less than the first likelihood determination threshold value Th1 ("No" in step S106), the directivity control unit 25 determines whether the probability P is less than the second likelihood determination threshold value Th2 (Step S108). In a case where the probability P is less than the second likelihood determination threshold value Th2 (3"Yes" in step S108), the directivity control unit 25 outputs only the first directivity sound spectrum from among the first directivity sound spectrum end the second directivity sound spectrum (step S109). For example, the directivity control unit 25 outputs the second directivity sound spectrum whose amplitude is zero over the entire frequency band, together with the first directivity sound spectrum. On the other hand, in a case where the probability P is equal to or greater than the second likelihood determination threshold value Th2 ("No" in step S108), the directivity control unit 25 outputs the second directivity sound spectrum suppressed in accordance with the probability P, together with the first directivity sound spectrum (step S110).

The frequency-time conversion unit 26 frequency-to-time converts the first directivity sound spectrum output from the directivity control unit 25 to calculate the first directivity sound signal. In addition, in a case where the second directivity sound spectrum is output, the frequency-time conversion unit 26 also frequency-to-time converts the second directivity sound spectrum to calculate the second directivity sound signal (step S111). The frequency-time conversion unit 26 shifts the first directivity sound signal up to the immediately preceding frame by a half frame length to synthesize the first directivity sound signal of the current frame. Similarly, the frequency-time conversion unit 26 shifts the second directivity sound signal up to the immediately preceding frame by a half frame length to synthesize the second directivity sound signal of the current frame (step S112). The sound processing device 13 ends the sound processing.

As explained above, the sound processing device calculates, for each frame, the probability that the sound is generated only by the sound source positioned in the second direction among a first direction in which a sound source which is prioritized with respect to sound reception is positioned, and a second direction in which another sound source is assumed to be positioned. When the probability is high, this sound processing device outputs not only the first directivity sound signal including the sound coming from the first direction, but also the second directivity sound signal including sound coming from the second direction. For example, when the probability is high, this sound processing device controls the directivity of the received sound so as to include not only the first direction, but also the second direction. In this way, for example, this sound processing device preferentially receives a sound generated by a specific speaker among a plurality of speakers, while receiving the sound generated by another speaker when the another speaker makes a sound.

According to the modification, the feature extraction unit 23 may calculate, for each frame, the power of the first directivity sound spectrum and the power of the second directivity sound spectrum, but may not calculate the non-station city degree as a feature amount representing likelihood of the sound from a sound source. In this case, the feature extraction unit 23 may calculate the probability P in accordance with the following Expression.

$$P = \frac{PY}{PX} \tag{5}$$

According to another modification, the directivity sound generation unit 22 may calculate the first directivity sound spectrum and the second directivity sound spectrum for each frame by a synchronous subtraction between the first frequency spectrum and the second frequency spectrum. In this case, the directivity sound generation unit 22 calculates the first directivity sound spectrum X(f) and the second directivity sound spectrum Y(f) in accordance with the following Expression.

$$X(f)=IN1(f)-r^{-j2\pi fn/N}IN2(f)$$

$$Y(f)=IN2(f)-r^{-j2\pi fn/N}IN1(f) \tag{6}$$

where N represents the total number of sampling points included in one frame, for example, the frame length. n represents a difference between a sampling time for the microphone 11-1 and a sampling time for the microphone 11-2 which the sound reaches from the sound source. The distance d between the microphone 11-1 and the microphone 11-2 is set to be equal to or less than (sound speed/Fs) so that $0<n\leq 1$, in other words, n is equal to or less than the sampling interval.

Figure 7:
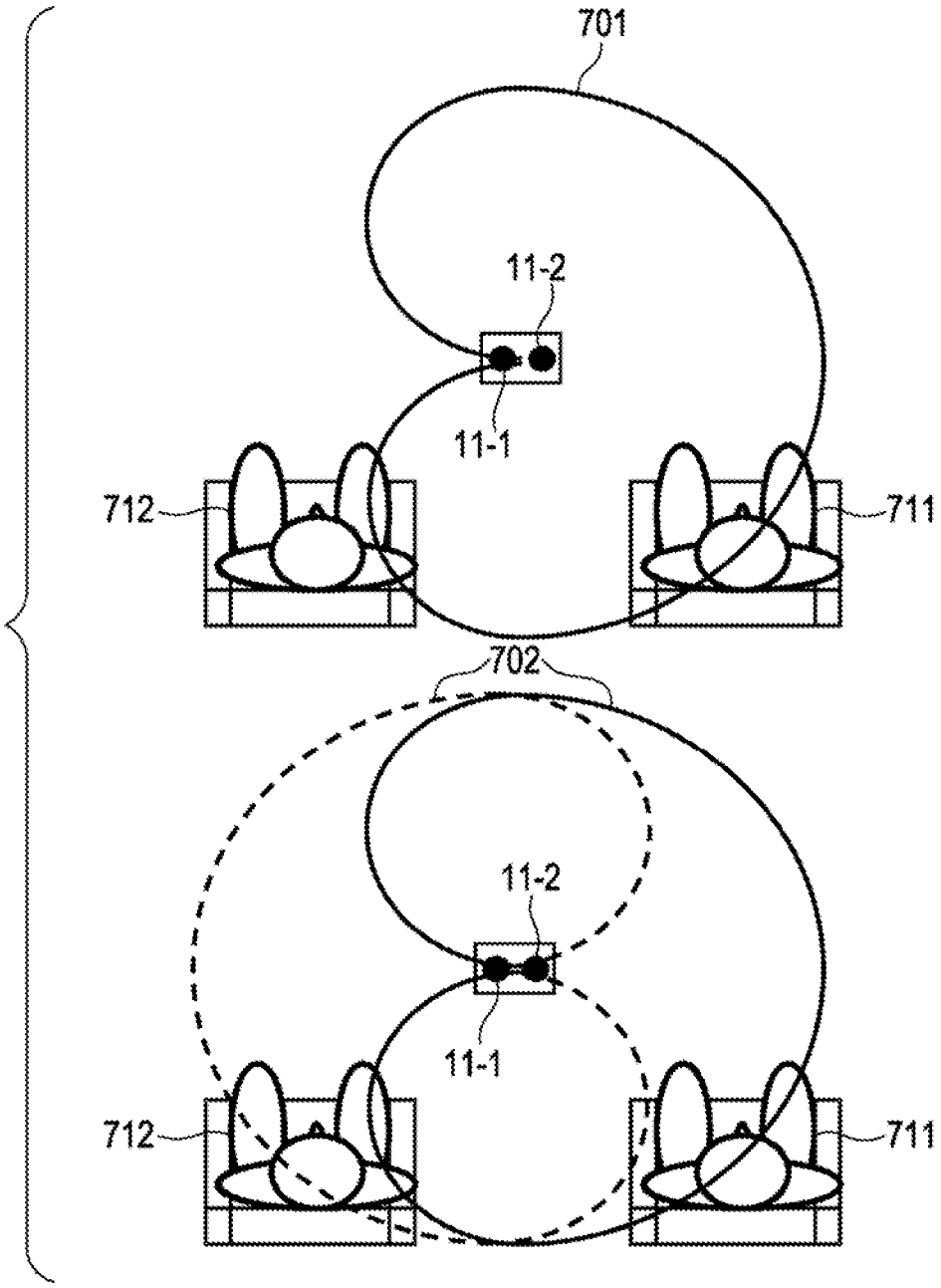
FIG. 7 is a schematic diagram illustrating directivities of a received sound according to a modification.

FIG. 7 is a schematic diagram illustrating directivities of a received sound according to this modification. In a case where the degree of the probability that the sound is generated only by the sound source positioned in the second direction is low, the range 701 where the sensitivity with which the sound is received is high, with respect to the arrangement direction of the microphone 11-1 and the microphone 11-2, is set toward the microphone 11-2 where the driver 711 is positioned. On the other hand, in a case where the degree of the probability that the sound is generated only by the sound source positioned in the second direction is high, a range 702 where the sensitivity with which the sound is received is high is set not only toward the microphone 11-2 but also toward the microphone 11-1 where a passenger 712 is positioned. In this example, a range in which the sensitivity with which the sound is received is high with respect to the first directivity sound signal, and a part of a range in which the sensitivity with which the sound is received is high with respect to the second directivity sound signal overlap.

According to still another modification, the directivity control unit 2 may output, for each frame, a spectrum obtained by multiplying the first gain representing the degree of suppression by the first directivity sound spectrum. Similarly, the directivity control unit 25 may output, for each frame, a spectrum obtained by multiplying the second gain representing the degree of suppression by the second directivity sound spectrum. The directivity control unit 25 may adjust the first gain and the second gain in accordance with the elapsed time from a time when the degree of the probability that the sound is generated only by the sound source positioned in the second direction has changed.

Figure 8:
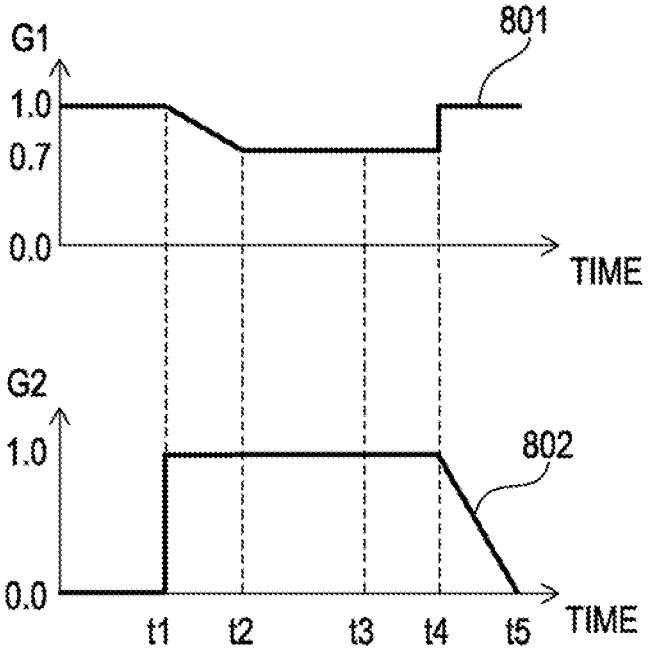
FIG. 8 is a diagram illustrating an example of the relationship between an elapsed time from a time when the degree of the probability that a sound is generated only by a sound source positioned in the second direction has changed and a first and a second gain.

FIG. 8 is a diagram illustrating an example of the relationship between the elapsed time from the time when the degree of the probability that the sound is generated only by the sound source positioned in the second direction has changed, and the first and second gains. In FIG. 8, the horizontal axis represents the time, and the vertical axis represents the gain. The graph 801 represents the relationship between the elapsed time from the time when the degree of the probability that the sound is generated only by the sound source positioned in the second direction has changed and the first gain. The graph 802 represents the relationship between the elapsed time from a time when the degree of the probability that the sound is generated only by the sound source positioned in the second direction has changed and the second gain.

In this example, it is assumed that the probability P that the sound is generated only by the sound source positioned in the second direction is equal to or less than the first likelihood determination threshold value Th1 until time t1, and the probability P has become greater than the first likelihood determination threshold value Th1 at time t1. In other words, it is assumed that the degree of the probability that the sound is generated only by the sound source positioned in the second direction has changed to high at time t1. Further, it is assumed that the probability P that the sound is generated only by the sound source positioned in the second direction is equal to or greater than the second likelihood determination threshold value Th2 from time t1 to time t3, and the probability P has become less than the second likelihood determination threshold value Th2 at time t3. In other words, it is assumed that the degree of the probability that the sound is generated only by the sound source positioned in the second direction has changed to low at time t3.

In this case, until time t1, the first gain G1 is set at 1, and on the other hand, the second gain G2 is set at 0. In other words, until the degree of the probability that the sound is generated only by the sound source positioned in the second direction has change to high, the directivity control unit 25 outputs the first directivity sound spectrum as it is and does not output the second directivity sound spectrum.

On the other hand, when the degree of the probability that the sound is generated only by the sound source positioned in the second direction changes to high at time t1, the directivity control unit 25 monotonically decreases the first gain G1 linearly for a certain period (for example, several tens of milliseconds) until the subsequent time t2. After time t2, the directivity control unit 25 sets the first gain G1 at a predetermined value that is $0<G1<1$ (in this example, 0.7). On the other hand, the directivity control unit 25 sets the second gain G2 at 1 after time t1. In other words, the directivity control unit 25 attenuates and outputs the first directivity sound spectrum, while outputting the second directivity sound spectrum as it is. In this way, the signal-to-noise ratio which is a ratio of a signal to the noise received from the first direction with respect to the sound from the second direction included in the second directivity sound signal is improved while the sound is coming from the sound source positioned in the second direction.

When the degree of the probability that the sound is generated only by the sound source positioned in the second direction changes to low at time t3, the directivity control unit 25 maintains the first gain G1 at a predetermined value for a certain period (for example, 100 milliseconds to 200 milliseconds) until the subsequent time t4. The directivity control unit 25 returns the first gain G1 to 1 after time t4. The directivity control unit 25 maintains the second gain G2 at 1 till time t4, and decreases the second gain G2 linearly monotonically after time t4. The directivity control unit 25 sets the second gain G2 at 0 after time t5, which is after time t4. In this way, even when the degree of the probability that the sound is generated only by the sound source positioned in the second direction changes to low, the second directivity sound spectrum is output for a certain period after that. For this reason, for example, it may be avoided that the rear end portion of the sound from the second direction included in the second directivity sound signal, for example, the ending portion of the conversational sound generated by the passenger positioned in the second direction, is interrupted. Therefore, for example, in a case where other equipment that has received the second directivity sound signal recognizes the passenger's sound from the second directivity sound signal, deterioration of recognition accuracy due to interruption of the ending part is avoided. The period from time t3 to time t5 is equal to or longer than the period from time t3 to time t4, and, for example, is set at 100 milliseconds to 300 milliseconds.

Figure 9:
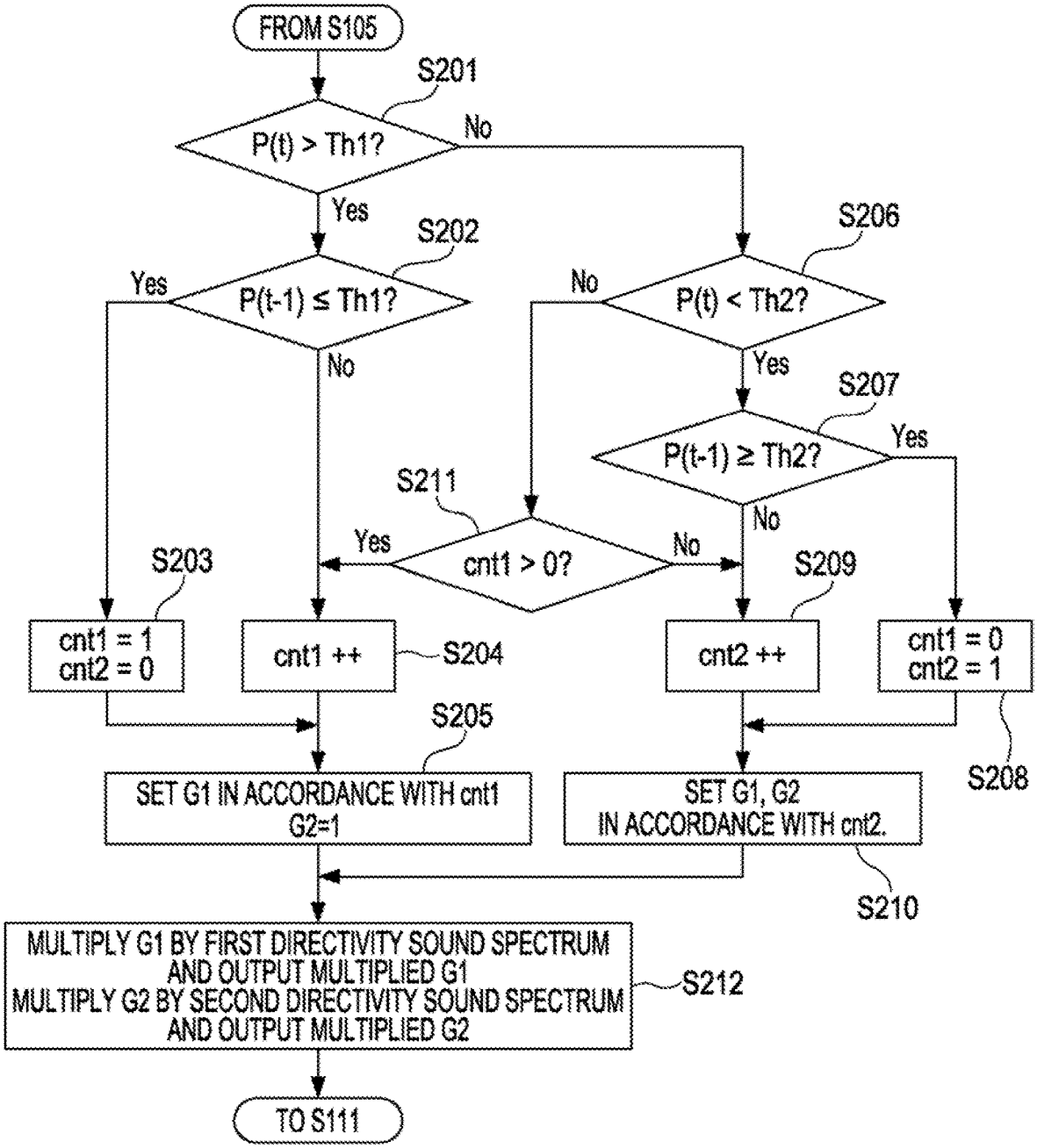
FIG. 9 is an operation flowchart of directivity control by a directivity control unit according to a modification.

FIG. 9 is an operation flowchart of the directivity control by the directivity control unit 25 according to this modification. The processing of the directivity control is performed in place of the processing of steps S106 to S110 in the operation flowchart of the sound processing illustrated in FIG. 6. In addition, in FIG. 9, the probability that the sound is generated only by the sound source positioned in the second direction in the current frame is denoted as P(t), and the probability that the sound is generated only by the sound source positioned in the second direction in the immediately preceding frame is denoted as P(t−1).

When the probability P(t) of the current frame is calculated in step S105 illustrated in FIG. 6, the directivity control unit 25 determines whether the probability P(t) is greater than the first likelihood determination threshold value Th1 (step S201). In a case where the probability P(t) is greater than the first likelihood determination threshold value Th1 ("Yes" in step S201), the directivity control unit 25 determines that the probability P(t−1) of the immediately preceding frame is equal to or less than the first likelihood determination threshold value Th1 (step S202). When the probability P(t−1) is equal to or less than the first likelihood determination threshold value Th1 ("Yes" in step S202), the probability that the sound is generated only by the sound source positioned in the second direction changes to high in the current frame. The directivity control unit 25 sets, at 1, the number of frames cnt1, which represents the elapsed time since the probability that the sound is generated only by the sound source positioned in the second direction has changed to high. The directivity control unit 25 sets, at 0, the number of frames cnt2, which, represents the elapsed time since the probability that the sound is generated only by the sound source positioned in the second direction has changed to low (step S203). In the initial state, the number of frames cnt1 is set at 0 so that the first gain G1 is 1 and the second gain G2 is 0, and the number of frames cnt2 is set at a value greater than the number of frames corresponding to the period from time t3 to time t5.

On the other hand, when the probability P(t−1) is greater than the first likelihood determination threshold value Th1 ("No" in step S202), the probability that the sound is generated only by the sound source positioned in the second direction is high even at the time of the immediately preceding frame, and the state in which the probability is high continues until the time of the current frame. For this reason, the directivity control unit 25 increments the number of frames cnt1 by 1 (step S204). After step S203 or S204, the directivity control unit 25 sets the first gain G1, for example, in accordance with the number of frames cnt1 as illustrated in FIG. 8, and sets the second gain G2 at 1 (step S205).

In step S201, in a case where the probability P(t) is equal to or less than the first likelihood determination threshold value Th1 ("No" in step S201), the directivity control unit 25 determines whether P(t) is less than the second likelihood determination threshold value Th2 (Step S206). In a case where P(t) is less than the second likelihood determination threshold value Th2 ("Yes" in step S206), the directivity control unit 25 determines that the probability P(t−1) of the immediately preceding frame is equal to or greater than the second likelihood determination threshold value Th2 (step S207). When the probability P(t−1) is equal to or greater than the second likelihood determination threshold value Th2 ("Yes" in step S207), the probability that the sound is generated only by the sound source positioned in the second direction has changed to low in the current frame. Therefore, the directivity control unit 25 sets the number of frames cnt1 at 0, and sets the number of frames cnt2 at 1 (step S208).

On the other hand, when the probability P(t−1) is less than the second likelihood determination threshold value Th2 ("No" in step S207), the probability that the sound is generated only by the sound source positioned in the second direction is low even at the time of the immediately preceding frame, and the state in which the probability is low is continuing until the current frame. For this reason, the directivity control unit 25 increments the number of frames cnt2 by 1 (step S209). After step S208 or S209, the directivity control unit 25 sets the first gain G1 and the second gain G2, for example, as illustrated in FIG. 8, in accordance with the number of frames cnt2 (step S210).

In a case where P(t) is equal to or greater than the second likelihood determination threshold value Th2 in step S206 ("No" in step S206), the state in which the probability is moderate is continuing in the current frame. The directivity control unit 25 determines whether the number of frames cnt1 is greater than 0 (step S211), When the number of frames cnt1 is greater than 0 (step S211—"Yes"), the directivity control unit 25 determines that the state in which the probability is high is continuing. The directivity control unit 25 increments the number of frames cnt1 by 1 (step S204). On the other hand, when the number of frames cnt1 is 0 ("No" in step S211), the number of frames cnt2 is greater than 0, so that the directivity control unit 25 determines that the state in which the probability is low is continuing. Therefore, the directivity control unit 25 increments the number of frames cnt2 by 1 (step S209).

After step S205 or step S210, the directivity control unit 25 multiplies the first gain G1 by the first directivity sound spectrum and then outputs the first directivity sound spectrum. The directivity control unit 25 multiplies the second gain G2 by the second directivity sound spectrum and then outputs the second directivity sound spectrum (step S212). The sound processing device 13 performs the processing after step S111 in FIG. 6.

According to this modification, the sound processing device may improve the signal-to-noise ratio with respect to the sound when only the sound source positioned in the second direction generates a sound, and may suppress the interruption of the end of the sound generated by the sound source positioned in the second direction. In this modification, one likelihood determination threshold value Th may be used instead of the two likelihood determination threshold values: the first likelihood determination threshold value Th1 and the second likelihood determination threshold value Th2. In this case, in the operation flowchart illustrated in FIG. 9, the directivity control unit 25 may perform directivity control with Th1=Th2=Th.

In the above embodiment or modification, the directivity control unit 25 may synthesize, for each frame, the first directivity sound spectrum and the second directivity sound spectrum after the gain is multiplied by them to output synthesized spectrum as a single spectrum. The frequency-time conversion unit 26 may frequency-to-time convert the one spectrum and synthesize it for each frame to calculate one directivity sound signal to output the directivity sound signal. Alternatively, the frequency-time conversion unit 26 may synthesize the first directivity sound signal and the second directivity sound signal to calculate one directivity sound signal to output the directivity sound signal.

The sound processing device according to the embodiment or the modification described above may be mounted on an apparatus other than the above-mentioned sound input device, for example, a telephone conference system or the like.

A computer program that causes a computer to implement each function of the sound processing device according to the above embodiment or modification may be provided in a form recorded in a computer readable medium such as a magnetic recording medium or an optical recording medium.

Figure 10:
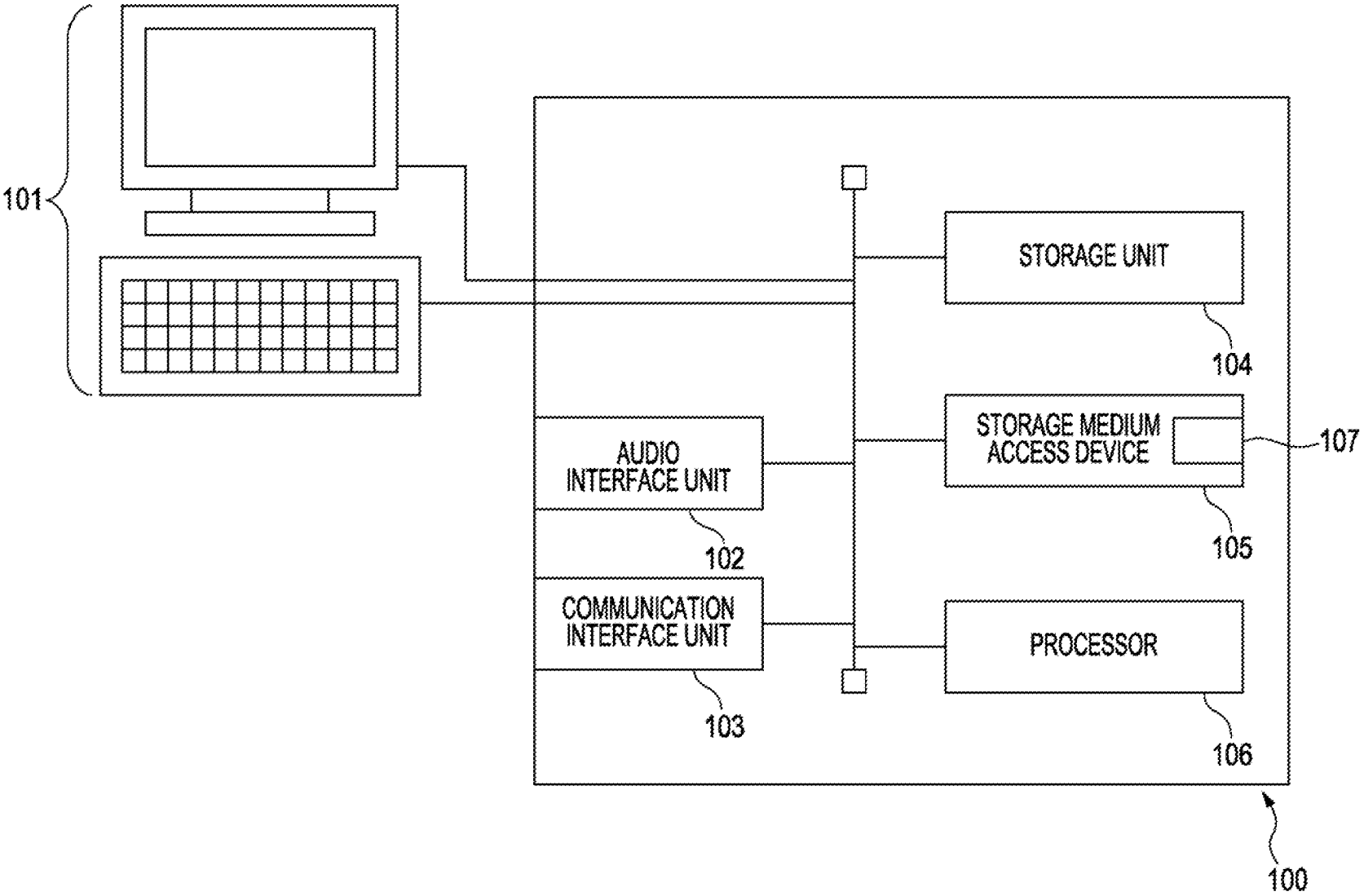
FIG. 10 is a configuration diagram of a computer that operates as a sound processing device in which a computer program implementing function of each unit of the sound processing device is executed according to an embodiment and its modification.

FIG. 10 is a configuration diagram of a computer that operates as a sound processing device in which a computer program implementing function of each unit of the sound processing device is executed according to the embodiment and its modification. A computer 100 includes a user interface unit 101, an audio interface unit 102, a communication interface unit 103, a storage unit 104, a storage medium access device 105, and a processor 106. The processor 106 is coupled to the user interface unit 101, the audio interface unit 102, the communication interface unit 103, the storage unit 104, and the storage medium access device 105, for example, via a bus.

The user interface unit 101 includes, for example, an input device such as a keyboard and a mouse, and a display device such as a liquid crystal display. Alternatively, the user interface unit 101 may include a device in which an input device and a display device are integrated, such as a touch panel display. The user interface unit 101, for example, in accordance with the user's operation, outputs an operation signal for starting sound processing to the processor 106.

The audio interface unit 102 has an interface circuit for coupling the computer 100 to a microphone (not illustrated). The audio interface unit 102 passes the input sound signal received from each of the two or more microphones to the processor 106.

The communication interface unit 103 has a communication interface for connecting to a communication network conforming to a communication standard such as Ethernet (registered trademark) and its control circuit. The communication interface unit 103 outputs, for example, each of the first directivity sound signal and the second directivity sound signal received from the processor 106 to other equipment via the communication network. Alternatively, the communication interface unit 103 may output the sound recognition result obtained by applying the sound recognition process to the first directivity sound signal and the second directivity sound signal to other equipment via the communication network. Alternatively, the communication interface unit 103 may output the signal generated by the application executed in accordance with the sound recognition result to other equipment via the communication network.

The storage unit 104 has, for example, a readable and writable semiconductor memory and a read-only semiconductor memory. The storage unit 104 stores a computer program for executing the sound processing where the computer program is executed on the processor 106, various data used in the sound processing, various signals generated in the middle of the sound processing, and the like.

The storage medium access device 105 is a device that accesses a storage medium 107 such as a magnetic disk, a semiconductor memory card, and an optical storage medium, for example. The storage medium access device 105 reads a computer program for sound processing executed on the processor 106, for example, where the computer program is stored in the storage medium 107, and passes it to the processor 106.

By executing the computer program for sound processing according to the embodiment or the modification described above, the processor 106 generates the first directivity sound signal and the second directivity sound signal from each input sound signal. The processor 106 outputs the first directivity sound signal and the second directivity sound signal to the communication interface unit 103.

The processor 106 may recognize the sound generated by the speaker positioned in the first direction by performing sound recognition processing on the first directivity sound signal. Similarly, the processor 106 may recognize the sound generated by another speaker positioned in the second direction by performing sound recognition processing on the second directivity sound signal. The processor 106 may execute a predetermined application in accordance with each sound recognition result.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A non-transitory, computer-readable recording medium having stored therein a program for causing a computer to execute a process, the process comprising:

dividing each of a first sound signal generated by a first sound input device and a second sound signal generated by a second sound input device disposed at a position different from the first sound input device, into frames having a predetermined time length, and converting each frame of the first sound signal and each frame of the second sound signal into a first frequency spectrum and a second frequency spectrum, respectively, in a frequency domain;

calculating, for each frame, based on the first frequency spectrum and the second frequency spectrum, a probability that a sound of the frame is emitted only from a sound source positioned in a second direction among sound sources positioned in a first direction which is prioritized with respect to sound reception and the second direction different from the first direction; and outputting, for each frame, a first directivity sound signal including a sound coming from the first direction, while controlling, depending on the probability, output of the first directivity sound signal and a second directivity sound signal including a sound coming from the second direction, each of the first directivity sound signal and the second directivity sound signal being calculated based on the first frequency spectrum and the second frequency spectrum.

2. The non-transitory, computer-readable recording medium of claim 1, wherein the output of the second directivity sound signal is controlled so that the second directivity sound signal is outputted for a frame for which the probability is greater than a first threshold value.

3. The non-transitory, computer-readable recording medium of claim 2, wherein, when the probability for a first frame is less than a second threshold value that is less than the first threshold value and when the probability for a frame immediately preceding the first frame is equal to or greater than the second threshold value, the output of the second directivity sound signal is stopped for frames after a first period has lapsed from the first frame.

4. The non-transitory, computer-readable recording medium of claim 3, wherein, when the probability for a second frame is greater than the first threshold value and when the probability for a frame immediately preceding the second frame is equal to or less than the first threshold value, the output of the first directivity sound signal is attenuated over a second period from the second frame.

5. The non-transitory, computer-readable recording medium of claim 4, wherein, when the probability for a third frame after the second frame is less than the second threshold value, a time at which a third period has elapsed from the third frame is set as an end of the second period.

6. The non-transitory, computer-readable recording medium of claim 1, the process further comprising calculating, for each frame, a first power of the first directivity sound signal and a second power of the second directivity sound signal, based on the first frequency spectrum and the second frequency spectrum, wherein the probability is calculated, for each frame, based on a power ratio of the second power of the second directivity sound signal to the first power of the first directivity sound signal.

7. The non-transitory, computer-readable recording medium of claim 6, the process further comprising calculating, for each frame, a first non-stationarity degree indicating a non-stationarity degree of power of the first directivity sound signal and a second non-stationarity degree indicating a non-stationarity degree of power of the second directivity sound signal, based on both the first frequency spectrum and the second frequency spectrum, wherein the probability is calculated, for each frame, based on a sum of a non-stationarity degree ratio of the second non-stationarity degree of the second directivity sound signal to the first non-stationarity degree of the first directivity sound and the power ratio.

8. A sound processing apparatus comprising:

a memory; and a processor coupled to the memory and configured to:

divide each of a first sound signal generated by a first sound input device and a second sound signal generated by a second sound input device disposed at a position different from the first sound input device, into frames having a predetermined time length, and convert each frame of the first sound signal and each frame of the second sound signal into a first frequency spectrum and a second frequency spectrum, respectively, in a frequency domain, calculate, for each frame, based on the first frequency spectrum and the second frequency spectrum, a probability that a sound of the frame is emitted only from a sound source positioned in a second direction among sound sources positioned in a first direction which is prioritized with respect to sound reception and the second direction different from the first direction, and output, for each frame, a first directivity sound signal including a sound coming from the first direction, while controlling, depending on the probability, output of the first directivity sound signal and a second directivity sound signal including a sound coming from the second direction, each of the first directivity sound signal and the second directivity sound signal being calculated based on the first frequency spectrum and the second frequency spectrum.

9. A sound processing method executed by a processor included in a sound processing apparatus, the sound processing method comprising:

dividing each of a first sound signal generated by a first sound input device and a second sound signal generated by a second sound input device disposed at a position different from the first sound input device, into frames having a predetermined time length, and converting each frame of the first sound signal and each frame of the second sound signal into a first frequency spectrum and a second frequency spectrum, respectively, in a frequency domain;

calculating, for each frame, based on the first frequency spectrum and the second frequency spectrum, a probability that a sound of the frame is emitted only from a sound source positioned in a second direction among sound sources positioned in a first direction which is prioritized with respect to sound reception and the second direction different from the first direction; and outputting, for each frame, a first directivity sound signal including a sound coming from the first direction, while controlling, depending on the probability, output of the first directivity sound signal and a second directivity sound signal including a sound coming from the second direction, each of the first directivity sound signal and the second directivity sound signal being calculated based on the first frequency spectrum and the second frequency spectrum.

* * * * *